United States Patent [19]

Ehama

[11] 4,270,511

[45] Jun. 2, 1981

[54] APPARATUS FOR SHOOTING A CURVE BALL

[75] Inventor: Goro Ehama, Fukuoka, Japan

[73] Assignee: Sun Sports Yohin Co., Ltd., Nagasaki, Japan

[21] Appl. No.: 84,240

[22] Filed: Oct. 12, 1979

[30] Foreign Application Priority Data

Oct. 14, 1978 [JP] Japan ..... 53-126402

[51] Int. Cl.[3] ..... F41D 11/00

[52] U.S. Cl. ..... 124/81; 124/56; 124/50; 124/83

[58] Field of Search ..... 124/56, 59, 60, 81, 124/83, 80, 41 R, 41 C, 1, 50

[56] References Cited

U.S. PATENT DOCUMENTS

| | | | |
|---|---|---|---|
| 1,404,378 | 1/1922 | Czegka | 124/6 |
| 2,508,461 | 5/1950 | Lemon | 124/56 X |
| 2,793,636 | 5/1957 | Cook | 124/6 |
| 3,855,988 | 12/1974 | Sweeton | 124/41 C X |

*Primary Examiner*—William R. Browne

*Attorney, Agent, or Firm*—Jordan and Hamburg

[57] ABSTRACT

An apparatus for shooting a curve ball used in the practice of baseball, table tennis, or tennis. A conventional shooting mechanism substantially comprises a flexible hose through which a ball is carried under air pressure, a loop holder which supports the shooting end of the flexible hose in a loop shape and a support strut which rigidly supports the loop holder. A novel feature of this invention is that the apparatus is further provided with a device which can rotate and tilt the loop holder so that the ball shot from the shooting end of the flexible hose can be imparted a desired kind of spin.

7 Claims, 20 Drawing Figures

APPARATUS FOR SHOOTING A CURVE BALL

BACKGROUND OF THE INVENTION

This invention relates to an apparatus which can impart a desired spin or other characteristics to a ball shot by air pressure, and is particularly useful in the practical exercise of learning to hit a ball properly in table tennis, tennis as well as baseball.

In a conventional pitching apparatus for beginners and children which uses a rubber ball with or without fuzz, an air blower is employed to produce pressurized air for shooting the ball. In operation, the air carries the ball under pressure through a flexible hose which has a shooting end portion thereof formed into a circular loop. When the ball reaches the loop, the ball is imparted a centrifugal force, and finally the ball provided with either a drive spin or a slice spin is shot out of the mouth of the flexible hose.

In the above operation, the direction of the kind of spin imparted to the ball depends on how the loop is arranged, namely whether the mouth of the flexible hose is located at the upper portion or at the lower portion of the loop.

However, in such conventional apparatus, the loop portion of the flexible hose is held by a circular ring arm which can arrange the loop at merely two positions, namely at an upward winding position or a downward winding position, so that the apparatus can shoot the ball with merely two kinds of spins, namely a drive spin and a slice spin. It must be also mentioned that such conventional apparatus is not equipped with a mechanism which provides the rapid shifting or change of the formation of the loop.

Accordingly, in an exercise using the conventional apparatus, a batter can readily understand which spin an oncoming ball is given since the apparatus shoots the ball with only two kinds of spins and the shifting of the loop formation is conducted relatively slow, whereby such exercise cannot simulate the actual situation in a baseball game.

It is an object of the present invention to provide an apparatus which can resolve the aforementioned defects of conventional baseball practicing machines.

It is another object of the present invention to provide an apparatus for shooting a curve ball which can be shot with a desired kind of spin.

It is still another object of the present invention to provide an apparatus for shooting a curve ball which can provide an optimal effect in the practicing of other ball games such as tennis and table tennis besides baseball.

DETAILED DESCRIPTION OF THE DISCLOSURE

The apparatus of this invention is described hereinafter in detail in conjunction with the attached drawings.

Figure 1:
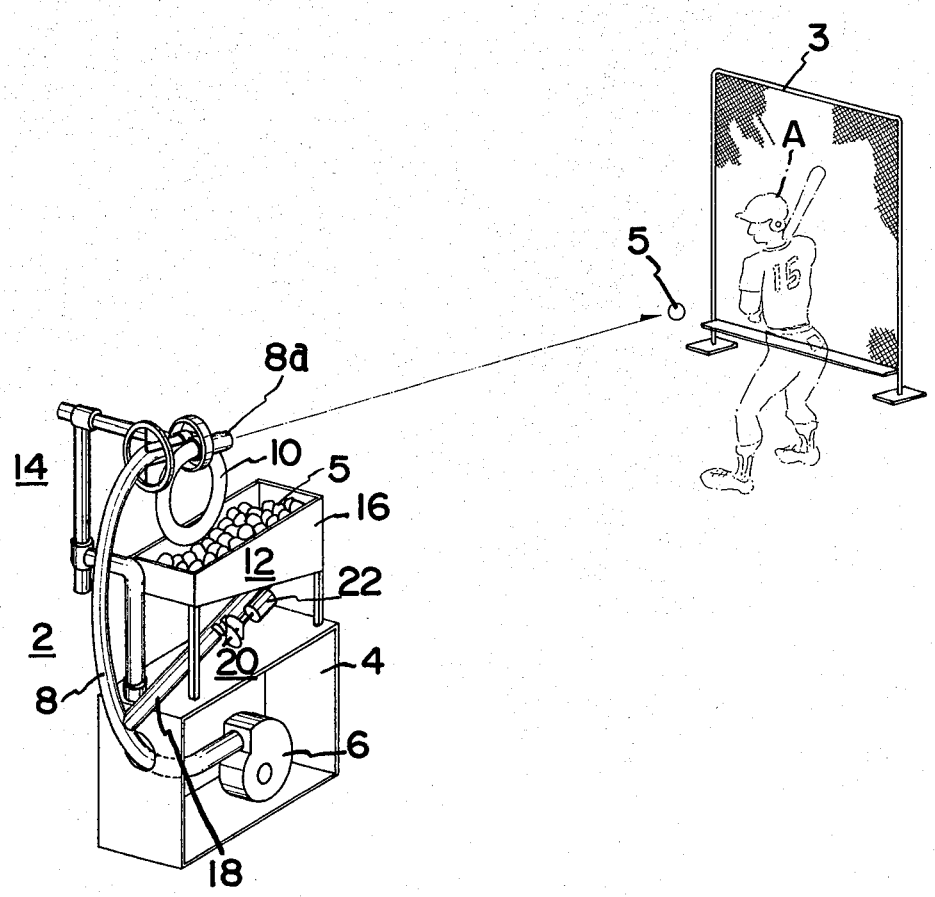
FIG. 1 is a perspective view of a baseball practicing machine provided with the apparatus of this invention.

FIG. 1 shows a baseball practicing machine 2 which is provided with an apparatus of this invention.

The machine 2 is located at a suitable distance from a back fence 3 in front of which a batter A stands.

The machine 2 substantially comprises a casing 4 which encases an air blower 6, a flexible hose 8 which has the proximal end connected to the air blower 6 and the distal end formed into a loop 10 with a shooting mouth 8*a* thereof directed toward the batter A, a ball feeding device 12 which intermittently feeds balls 5 into the flexible hose 8 and an apparatus 14 for shooting a curve ball of this invention which can rotatably, tiltably, elevatably support the loop 10 of the flexible hose 8.

Figure 2:
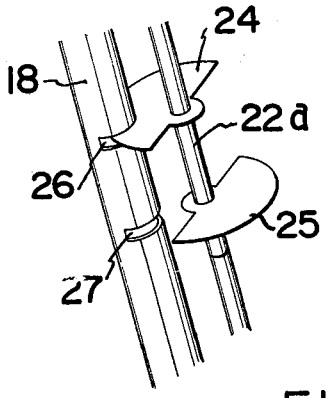
FIG. 2 is an explanatory view showing the construction of the intermittent ball feeding mechanism.

In the above construction, the ball feeding device 12 comprises a ball storing tank 16 mounted on the casing 4, a ball feeder pipe 18 which connects the ball storing tank 16 with the flexible hose 8 and an intermittent feeder mechanism 20 mounted on the middle portion of the ball feeder pipe 18. The intermittent feeder mechanism 20 is shown in FIGS. 2 to 3*c* in detail, wherein the mechanism 20 comprises a motor 22 mounted on the ball feeder pipe 18, a pair of spaced-apart semi-circular plates 24, 25 which are fixedly mounted on a drive shaft 22*a* of the motor 22 at a distance slightly bigger than the diameter of the ball 5 in radially opposed directions, and a pair of spaced-apart grooves 26, 27 formed on the ball feeder pipe 18 at locations corresponding to the semi-circular plates 24, 25 for receiving these plates 24, 25 alternately upon rotation of the motor 22.

Figure 4:
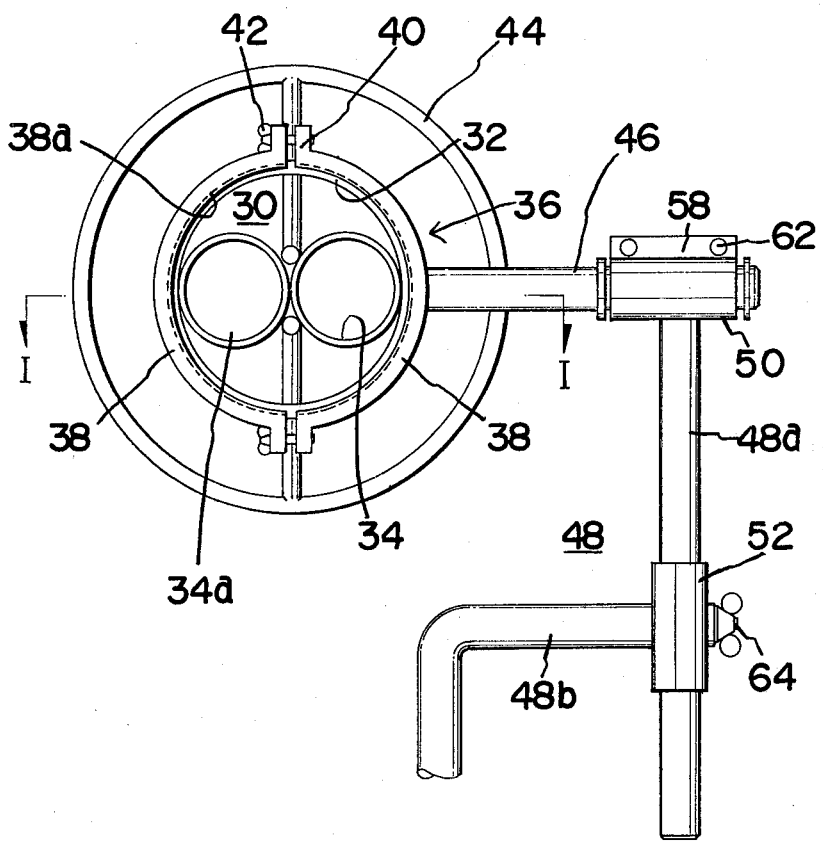
FIG. 4 is a front view of the apparatus of this invention.
Figure 5:
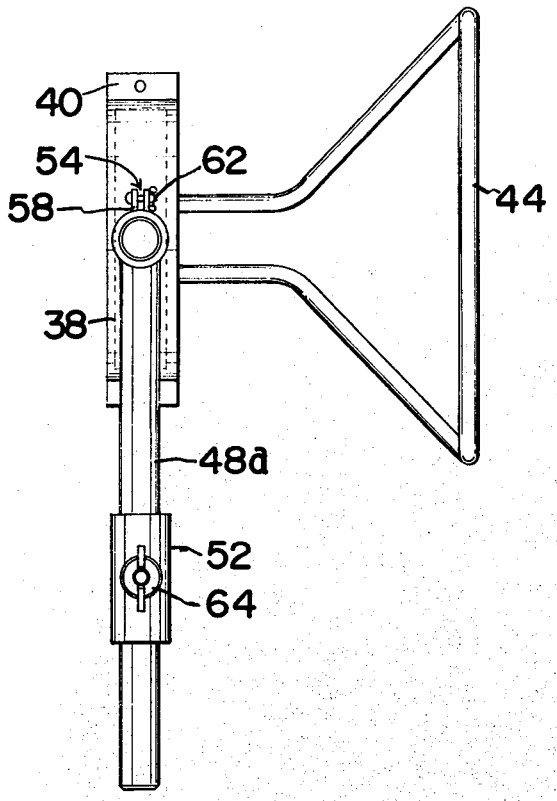
FIG. 5 is a side view of the above apparatus.
Figure 6:
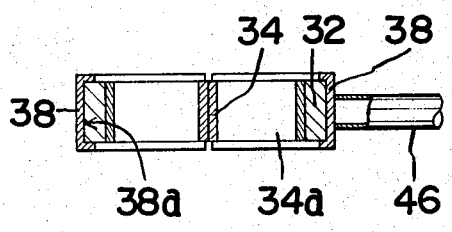
FIG. 6 is a cross-sectional view taken along the line I—I of FIG. 4.

The construction of the apparatus 14 for shooting a curve ball of this invention is shown in FIG. 4 to FIG. 6.

Figure 8:
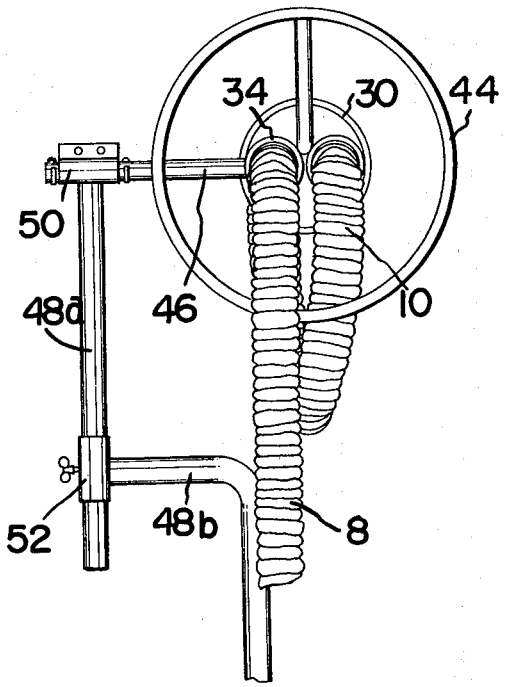
FIG. 8 is a partial rear view of the above apparatus.

In FIG. 4, a loop holder 30 comprises a large circular ring 32 and a pair of small circular rings 34 disposed within and welded to the large circular ring 32 in the shape of a figure 8. The shooting end portion of the flexible hose 8 is inserted into the circular openings 34*a* of the small circular rings 34 such that the small circular rings 34 stably support the end of the flexible hose 8 in a loop shape with a straight portion 8*b* leading to the mouth 8*a* directed to the batter A. The loop holder 30 is rotatably enclosed by an outer circular support ring 36 which comprises a pair of semi-circular rings 38. These semi-circular rings 38 have rotatably semi-circular grooves 38*a* formed in the inner surface thereof and a pair of longitudinal lugs 40 in a radial direction at the ends thereof.

In assembly, the loop holder 30 is encased into the grooves 38*a* of the semi-circular rings 38 and subsequently wing bolts 42 fasten the semi-circular rings 38 by way of lugs 40. By adjusting the fastening force of the wing bolts 42, the loop holder 30 freely rotates within the outer circular support ring 36 or is fixedly secured to the support ring 36 at a desired angle relative to the outer support ring 36.

A coaxial circular handle 44 is attached to the loop holder 30 integrally such that the manipulation of the handle 44 causes the rotation of the loop holder 30 relative to the outer circular support ring 36.

The apparatus of this invention is also provided with a device which tiltably, swingably (on a horizontal plane) and elevatably supports the loop holder 30. The device substantially comprises a horizontally disposed lateral shaft 46 which has the distal end thereof secured to the middle portion of one of the semi-circular rings 38 and a vertical support column 48 stood on the ground for rotatably and elevatably supporting the lateral shaft 46. To be more specific, the vertical support column 48 consists of an upper support portion 48*a* and an L-shaped lower support portion 48*b* which are fixedly mounted on the casing 4. A horizontal bearing 50 is mounted on the top of the vertical support column 48 and rotatably supports the proximal end of the lateral shaft 46, while a vertical bearing 52 is mounted on the top of the lower support 48*b* which rotatably and elevatably supports the upper vertical portion 48*a* relative to the lower support portion 48*b*.

Bearing 50 has a longitudinal slit 54, a pair of longitudinal lugs 58 projected radially from the outer surface of the bearing 50 along the slit 54 and wing bolts 62 which fasten the slit 54 by way of the longitudinal lugs 58.

Bearing 52 has a vertical circular tube construction in which the lower end of the upper support portion 48*a* is slidably and rotatably received. The bearing 52 is also provided with a wing bolt 64 which is threadedly mounted on the side portion of the bearing 52 for retaining the upper support column 48*a* at a desired angle and level relative to the bearing 52.

Due to such construction, along with the rotation of the lateral shaft 46 on the axis thereof, the outer support ring 36 and the loop holder 30 are integrally tilted in either lateral direction and these members 36, 30 can be fastened at a desired tilting angle relative to a vertical plane which passes through the axis of the lateral shaft 46.

Furthermore, the loop holder 30 and the outer support ring 36 can be horizontally rotated on the vertical axis of the upper support portion 48*a* and are elevatable in either upward or downward direction. By fastening wing bolts 64, these members 30, 36 are also fastened at a desired rotating angle relative to the vertical bearing 52 and at a desired level relative to the ground.

The manner in which the practicing machine 2 which is provided with the apparatus of this invention is operated is hereinafter disclosed.

Figure 3A:
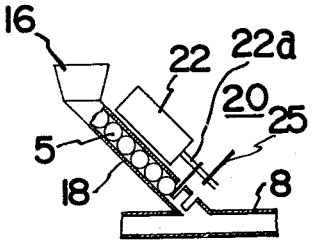
FIG. 3A to FIG. 3C are explanatory views showing the manner of operation of the intermittent ball feeding mechanism.
Figure 3B:
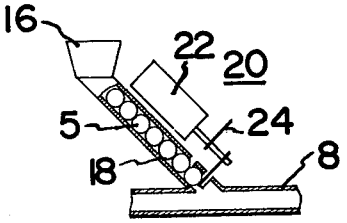
Figure 3C:
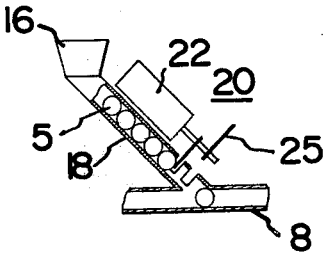

When a plurality of balls 5 are charged into the ball feeder pipe 18, these balls 5 take a position shown in FIG. 3A, wherein the balls 5 are stopped by the upper semi-circular plate 24. When the upper semi-circular plate 24 rotates out from the upper groove 26, as shown in FIG. 3B, all the balls 5 roll one step downward from the upper semi-circular plate 24. However, since simultaneous with the above operation, the lower semi-circular plate 25 positions within the lower groove 27, the balls 5 rest on the lower semi-circular plate 25 until another half rotation finishes. Subsequently, when the lower semi-circular 25 further rotates out from the lower groove 27, as shown in FIG. 3C, one ball 5 on the lower semi-circular plate 25 rolls downward. However, since the upper semi-circular plate 24 simultaneously reaches and positions within the upper groove 26, the remaining balls 5 rests on the upper semi-circular plate 24. Namely, the semi-circular plates 24, 25 take the same position as that of FIG. 3A. Due to the above mechanism, along with each single rotation of the rotating shaft 22*a*, one ball is fed into the flexible hose 8.

Subsequently, the pressurized air produced by the air blower 6 carries the ball 5 along and within the flexible hose 8 and eventually the ball 5 with a desired spin which is imparted by the loop 10 of the flexible hose 8 is shot from the mouth 8*a* of the flexible hose 8 thus producing a curve ball.

Figure 7:
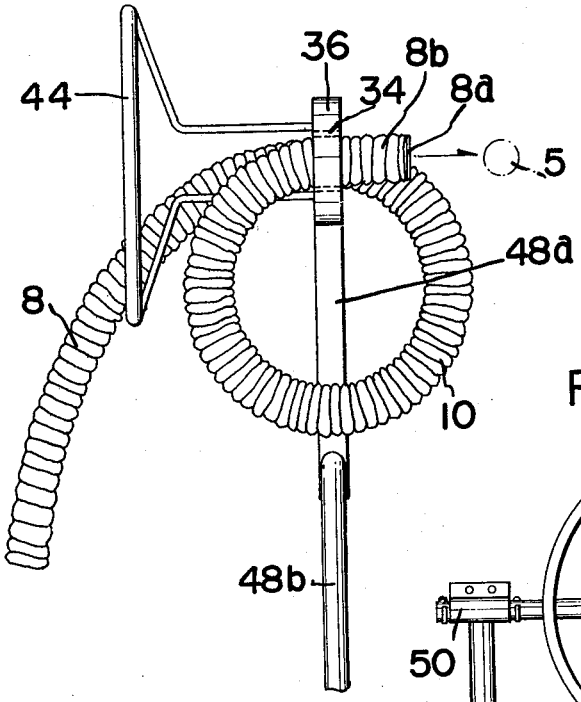
FIG. 7 is a partial side view of the apparatus showing the formation of the loop at the shooting end of the flexible-hose-made shooter.

Referring now to the specific operation of the apparatus 14 of this invention, the end portion of the flexible hose 8 adjacent to the mouth 8*a* is first shaped into the loop 10 as shown in FIG. 7 by passing the flexible hose 8 through the circular openings 34*a* of the small circular rings 34. The loop 10 forms approximately a circle and can take either upward or downward winding direction. For example, when the loop 10 is formed by winding downwardly with the mouth located at the uppermost portion of the loop 10, the ball 5 which flows under pressure within the flexible hose 8 with the actuation of the air blower 6 rotates along the lower circuitry of the loop 10. During the above rotation, the ball receives a centrifugal force and thereby the ball 5 rolls on the radially outermost inner surface of the loop 10 while receiving the friction resistance from the loop 10 and eventually the ball 5 having a "slice" spin is shot from the mouth 8*a* of the flexible hose 8.

Figure 9:
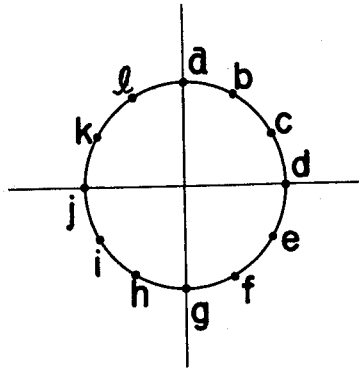
FIG. 9 is an explanatory view showing various striking points on the spherical surface of the ball.
Figure 10A:
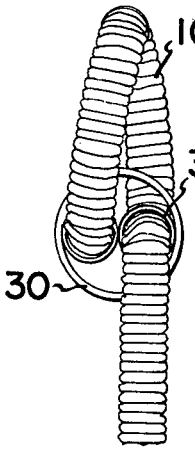
FIG. 10(*a*) to FIG. 10(*f*) are explanatory views showing the rotating positions corresponding to the striking points of the ball in FIG. 9.
Figure 10A:
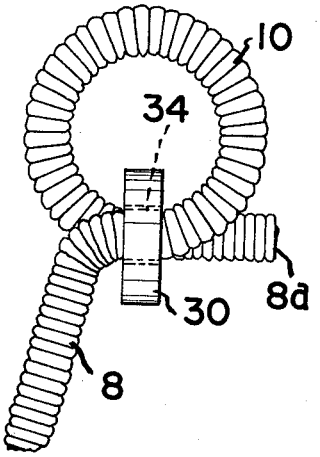
Figure 10B:
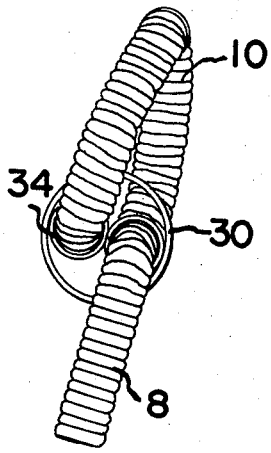
Figure 10C:
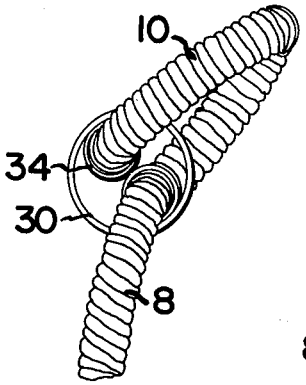
Figure 10D:
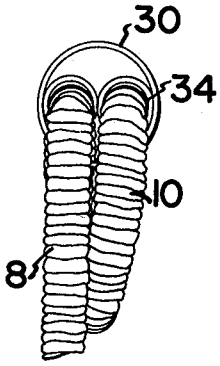
Figure 10E:
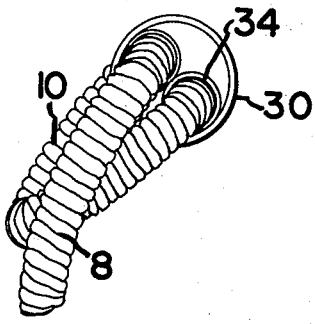
Figure 10F:
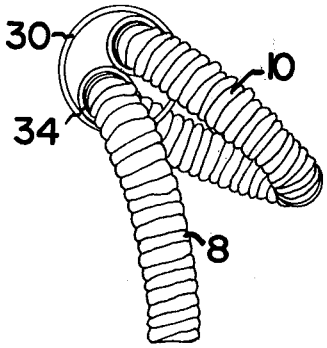

The slice spin of the ball 5 obtained in the above operation is similar to the one when the ball 5 is struck tangentially at a lowermost point g on the spherical surface thereof as shown in FIG. 9. This is achieved by positioning the loop holder 30 as shown in FIG. 10(*d*).

When the loop holder 30 is rotated 30° in a clockwise direction taking a position as shown in FIG. 10(*e*) or 60° in a counter-clockwise direction taking a position as shown in FIG. 10(*f*) by manipulating the handle 44, the ball 5 shot from the flexible hose 8 can have side slide spin which is similar to the spins produced by striking tangentially the points (h) and (e) of the spherical surface of the ball 5 in FIG. 9 respectively.

Furthermore, since the loop holder 30 is rotatable 360°, the loop holder 30 can readily change its position from a position shown in FIG. 10(*d*) to a position shown in FIG. 10(*a*). In this position, since the loop 10 is turned in an upward winding direction with the mouth 8*a* located at the lower portion of the loop 10, the ball 5 receives a "drive" spin which is similar to the spin produced by tangentially striking the point (a) of the spherical surface of the ball 5 and is projected or shot from the mouth 8*a*. Similarly, it can be readily understood that in the positions shown in FIG. 10(*b*) and FIG. 10(*c*), the ball 5 receives side drive spins which are produced by striking tangentially the points (b) and (c) of FIG. 9 respectively.

As described above, according this invention the spin can be imparted in any area or point on the spherical surface of the ball 5, and the area can be quickly changed by rotating the loop holder 30, the ball 5 with a desired spin can be easily produced.

Furthermore, since the outer support ring 36 is tiltably and rotatably (on a horizontal plane) supported by the L-shaped lower column 48*b*, the ball 5 of a desired spin can be shot also from a variable level and a variable direction, thus enabling the simulation of the various manners of throwing such as underarm throwing, overhead throwing, right-hand throwing or left-hand throwing.

The present invention is not necessarily limited to the embodiment described heretofore, rather it includes some modifications or improvements within the scope of protection.

Figure 11:
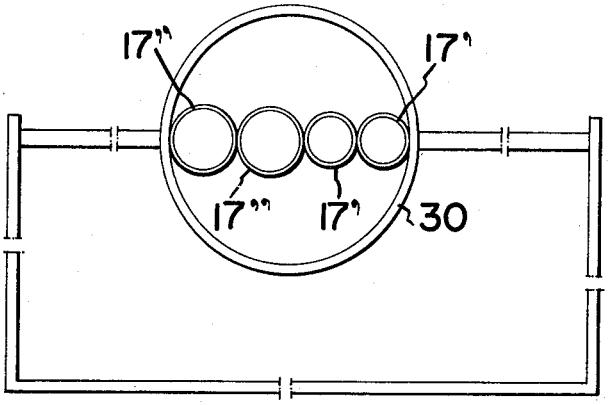
FIG. 11 is a front view of a modification of a loop holder of this invention.
Figure 12:
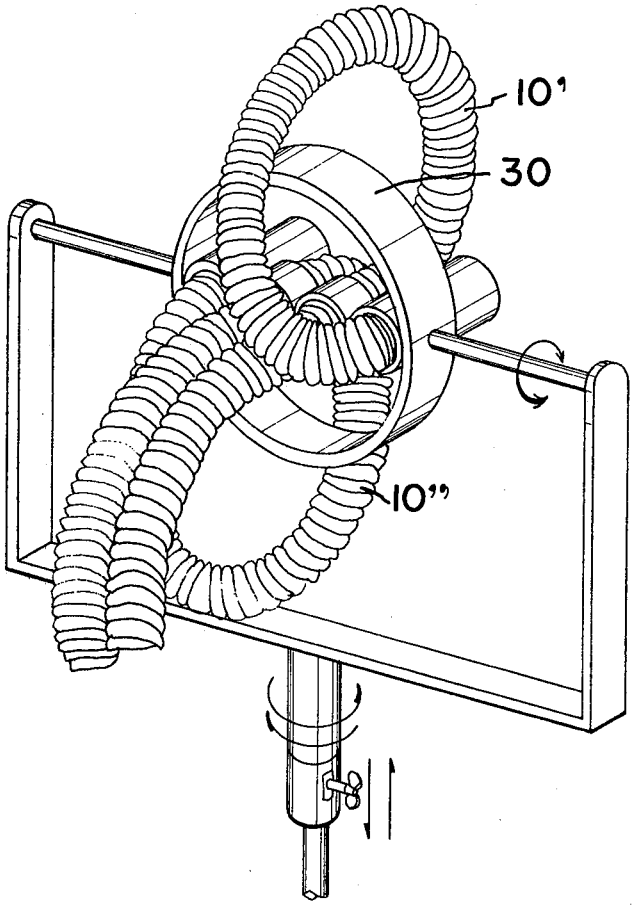
FIG. 12 is an explanatory view showing the operation of the above holder.

For example, the loop holder 30 can be made by a circular plate provided with a pair of openings which allow the flexible hose made shooter 8 to pass through. These openings may be merged to form a single elongated opening. Furthermore, although in the above embodiment, the loop 10 is of a single turn, the loop 10 can be wound for more than two turns. Still furthermore, the loop holder 30 and the loop 10 can have the construction shown in FIG. 11 and FIG. 12. In this modification, the loop holder 30 is provided with parallely arranged four small circular rings 17', 17', 17'', 17'' wherein two circular rings 17', 17' support one loop 10' such that a ball with a drive spin can be shot while the other two circular rings 17'', 17'' support another loop 10'' such that a ball with a slice spin can be shot.

It is preferable that the diameter of the hose of loop 10'' for shooting the ball with a slice spin is greater than that of the hose of loop 10' which is used for shooting a ball with a drive spin. Of course, the ball can be shot in a desired manner using either one of the hoses for loop 10' or 10''.

Although the loop holder 30 is rotated manually with the manipulation of the handle 44, such rotation can be imparted by a power-operated motor. For example, gear teeth are formed on the periphery of the large circular ring 32 and a pinion which is mounted on the drive shaft of the power-operated motor is meshed to the toothed large circular ring.

Modification can be also made to the flexible hose 8. Although in the above embodiment, the flexible hose 8 is made of a bellow hose, the hose 8 can be made of an ordinary tube of conventional shape and material so long as the flexibility is retained.

The apparatus of this invention can also be employed in the practicing of tennis or table tennis.

Figure 13:
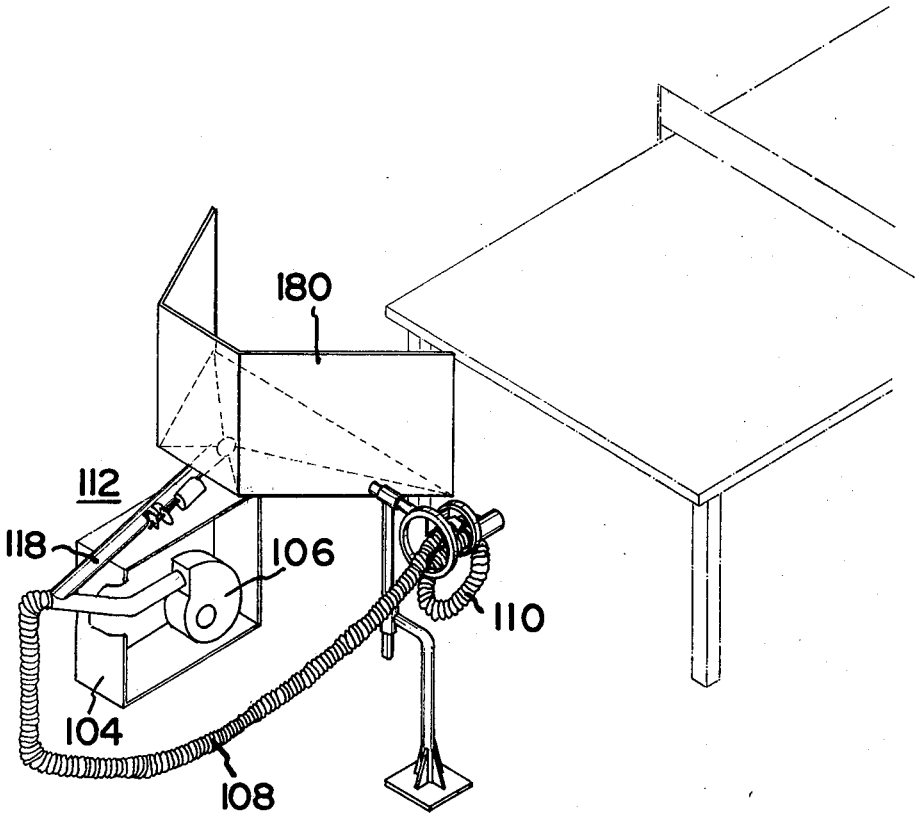
FIG. 13 is a perspective view of a table tennis practicing machine provided with the apparatus of this invention.

FIG. 13 shows the apparatus of this invention utilized in the training of table tennis, wherein the like parts are indicated by the same numerals adding 100 thereto.

The apparatus has substantially the same construction as that of the apparatus employed for the baseball practicing machine with the exception that the apparatus is provided with a ball collecting screen 180 which receives the ping-pong ball hit by a receiver and works also as a ball storing tank.

As has been described heretofore, the apparatus of this invention has the following advantages.

(1) Since the loop holder can be readily rotated 360° by manipulating the handle attached to the holder, a ball with a drive spin can be shot from the apparatus soon after a ball with a slice spin which has a completely opposite rotating direction is shot from the same apparatus. Therefore, the apparatus can simulate a situation where a batter is actually facing a pitcher in a baseball game.

(2) Since the loop holder can be rotated 360° and can be firmly positioned at a desired rotating angle, the ball with a desired kind of spin can be readily obtained.

(3) Within a short period of practice, even beginners can easily hit curve balls, the hitting of which has been extremely difficult for them.

Furthermore, since the ball used in the practicing machine is, in general, small and soft, even when the ball hits the batter, the ball does not injure him. Accordingly, even children and beginners can safely use the apparatus.

(4) In table tennis, especially in service, a server may have to deliver a ball with different spin in each servicing to have an advantage position while a receiver has to hit back such balls. The apparatus of this invention can readily simulate such situation thereby offering an optimal practice to the receiver.

What I claim is:

1. In an apparatus which shoots a ball through a flexible hose by means of air pressure, the improvement is characterized in that said apparatus further comprises, (1) a circular loop holder which holds a shooting end portion of said flexible hose in a loop shape, formed by looping the flexible hose back adjacent to its self, and by passing said hose therethrough substantially perpendicular to a flat plane formed by said loop holder, (2) a first loop-holder support means rotatably supporting said circular loop holder on the axis of said loop holder, and (3) a second loop-holder supporting means tiltably supporting said loop holder relative to an axis which is perpendicular to the axis of said loop holder, whereby along with the rotating of said holder on the axis of said loop holder and the tilting of said loop holder relative to said vertical plane, a variety of spins may be imparted to a ball to be shot.

2. Apparatus according to claim 1, wherein said loop holder comprises a large circular ring and a pair of small circular rings disposed within and fixedly attached to said large circular ring in the shape of a figure 8, said small circular rings having diameters sufficient to snugly receive a portion of the flexible hose intermediate its ends and said shooting end portion.

3. Apparatus according to claim 1, wherein said loop holder is a circular flat plate provided with a pair of circular openings of the same diameter, said diameter being sufficient to snugly receive a portion of the flexible hose intermediate its ends and said shooting end portion.

4. Apparatus according to claim 1, wherein said first loop-holder support means comprises an outer circular support ring which is formed by connecting two semi-circular rings, said semi-circular rings having semi-circular grooves formed in the inner surface thereof for rotatably encasing said loop holder when they are formed into said outer circular support ring.

5. Apparatus according to claim 1, wherein said loop holder is provided with a coaxial handle which facilitates the rotation of said loop holder relative to said first loop-holder support means.

6. Apparatus according to claim 1, wherein said second loop-holder support means comprises a horizontally disposed lateral shaft which has the distal end thereof secured to said first loop-holder support means and a vertical column stood on a ground for rotatably supporting another end of said lateral shaft on the axis of said lateral shaft, said rotation imparting a tilting movement to said loop holder by way of said first loop-holder support means.

7. Apparatus according to claim 6, wherein said vertical column comprises an upper support portion which has the top end thereof connected with said lateral shaft by way of a horizontal bearing and a lower support portion which rotatably and elevatably supports said upper support portion by way of a vertical bearing.

* * * * *